US010653249B2

(12) United States Patent
Schmitz et al.

(10) Patent No.: US 10,653,249 B2
(45) Date of Patent: May 19, 2020

(54) CHAIR

(71) Applicants: Burkhard Schmitz, Berlin (DE); Carola Zwick, Berlin (DE); Roland Zwick, Berlin (DE)

(72) Inventors: Burkhard Schmitz, Berlin (DE); Carola Zwick, Berlin (DE); Roland Zwick, Berlin (DE)

( * ) Notice: Subject to any disclaimer, the term of this patent is extended or adjusted under 35 U.S.C. 154(b) by 0 days.

(21) Appl. No.: 16/129,934

(22) Filed: Sep. 13, 2018

(65) Prior Publication Data

US 2019/0029440 A1 Jan. 31, 2019

Related U.S. Application Data

(63) Continuation of application No. PCT/EP2017/056004, filed on Mar. 14, 2017.

(30) Foreign Application Priority Data

Mar. 14, 2016 (DE) ..... 10 2016 104 636

(51) Int. Cl.

| | |
|---|---|
| ***A47C 1/00*** | (2006.01) |
| ***A47C 1/023*** | (2006.01) |
| ***A47C 3/025*** | (2006.01) |
| ***A47C 3/26*** | (2006.01) |
| ***A47C 31/12*** | (2006.01) |
| ***A47C 7/44*** | (2006.01) |
| ***A47C 1/032*** | (2006.01) |

(52) U.S. Cl.

CPC ..... *A47C 31/126* (2013.01); *A47C 1/03277* (2013.01); *A47C 7/441* (2013.01); *A47C 7/445* (2013.01)

(58) Field of Classification Search

CPC ... A47C 31/126; A47C 1/03277; A47C 7/441; A47C 7/445

USPC ..... 297/300.1–300.8, 337

See application file for complete search history.

(56) References Cited

U.S. PATENT DOCUMENTS 4,889,385 A * 12/1989 Chadwick ..... A47C 3/026 297/300.1

4,911,501 A * 3/1990 Decker ..... A47C 1/03255 297/300.8

(Continued)

FOREIGN PATENT DOCUMENTS

DE 10 2013 005 861 A1 10/2014

WO 2007/110732 A2 10/2007

OTHER PUBLICATIONS

English translation of International Preliminary Report on Patentability (Chapter I) (Application No. PCT/EP2017/056004) dated Sep. 27, 2018, 6 pages.

(Continued)

*Primary Examiner* — Rodney B White

(74) *Attorney, Agent, or Firm* — Burr & Brown, PLLC

(57) ABSTRACT

A chair including a subframe, a seat element, a back element, a spring mechanism and an adjustment device. The spring mechanism includes a leaf spring, which is clamped on one side in the subframe, and a support, which is movable on a track between the leaf spring and the subframe. The adjustment device includes an adjustment member and a transmission mechanism. A movement of the adjustment member is translated into a movement of the support at a transmission ratio of between 1:0.5 and 1:4.

12 Claims, 11 Drawing Sheets

(56) References Cited

U.S. PATENT DOCUMENTS 5,035,466 A * 7/1991 Mathews ..... A47C 1/023 297/337
5,046,780 A * 9/1991 Decker ..... A47C 1/03255 297/300.8
5,048,893 A * 9/1991 Cowan ..... A47C 9/002 297/313
5,288,138 A * 2/1994 Stulik ..... A47C 1/03255 297/302.1
5,348,372 A * 9/1994 Takamatsu ..... A47C 1/0325 297/301.1
5,356,199 A * 10/1994 Elzenbeck ..... A47C 3/026 297/311
5,397,165 A * 3/1995 Grin ..... A47C 1/03255 297/300.5
5,603,551 A * 2/1997 Sheehan ..... A47C 3/0257 297/216.19
6,027,168 A * 2/2000 Crossman ..... A47C 1/023 297/322
6,135,556 A * 10/2000 Chu ..... A47C 1/023 297/337 X
6,193,313 B1 * 2/2001 Jonsson ..... A47C 1/023 297/337 X
6,250,715 B1 * 6/2001 Caruso ..... A47C 1/03 297/300.2
6,634,711 B2 * 10/2003 Phillips ..... A47C 1/023 297/337
6,688,692 B2 * 2/2004 Phillips ..... A47C 1/023 297/337 X
6,824,215 B2 * 11/2004 Koepke ..... A47C 1/023 297/337
6,871,909 B2 * 3/2005 Hobb ..... A47C 3/026 297/300.8
6,926,361 B2 * 8/2005 Link ..... A47C 1/023 297/337 X
6,986,550 B2 * 1/2006 Gevaert ..... A47C 1/023 297/337 X
6,994,400 B2 * 2/2006 Koepke ..... A47C 1/023 297/337
7,172,250 B2 * 2/2007 Wu ..... A47C 1/023 297/337
7,273,253 B2 * 9/2007 Deimen ..... A47C 1/03222 297/300.2
7,341,233 B2 * 3/2008 McMains ..... A47C 1/023 248/424
7,380,881 B2 * 6/2008 Freed ..... A47C 1/023 297/337 X
7,625,045 B2 * 12/2009 Hatcher ..... A47C 1/03222 297/300.2
7,806,478 B1 * 10/2010 Cvek ..... A47C 1/03255 297/300.1
7,857,390 B2 * 12/2010 Schmitz ..... A47C 1/03255 297/300.1
7,922,248 B2 * 4/2011 Aldrich ..... A47C 1/023 297/316
7,992,937 B2 * 8/2011 Plikat ..... A47C 1/03255 297/300.2
8,210,611 B2 * 7/2012 Aldrich ..... A47C 1/023 297/284.11
8,419,133 B2 * 4/2013 Holt ..... A47C 1/023 297/354.11
8,469,454 B2 * 6/2013 Holt ..... A47C 1/023 297/452.63
8,991,921 B2 * 3/2015 Peterson ..... A47C 1/023 297/284.1
9,216,673 B2 * 12/2015 Braun ..... B60N 2/07
9,386,858 B2 * 7/2016 Chen ..... A47C 1/023
9,560,917 B2 * 2/2017 Roslund, Jr. ..... A47C 7/44
2001/0050503 A1 * 12/2001 Piretti ..... A47C 1/023 297/337
2004/0183350 A1 * 9/2004 Schmitz ..... A47C 1/03255 297/301.1
2006/0202530 A1 * 9/2006 Lin ..... A47C 1/03238 297/300.1
2008/0084100 A1 * 4/2008 Curiger ..... A47C 1/03238 297/300.4
2008/0258531 A1 * 10/2008 Lu ..... A47C 1/023 297/337
2012/0074749 A1 * 3/2012 Hsiao ..... A47C 1/023 297/337
2013/0069408 A1 * 3/2013 Chen ..... A47C 1/03205 297/337
2014/0246890 A1 * 9/2014 Lee ..... A47C 1/023 297/337

OTHER PUBLICATIONS

International Search Report and Written Opinion (Application No. PCT/EP2017/056004) dated May 31, 2017.

* cited by examiner

CHAIR

CROSS REFERENCE TO RELATED APPLICATIONS

This application is a continuation of International Application No. PCT/EP2017/056004 filed Mar. 14, 2017, which designated the United States, and claims the benefit under 35 USC § 119(a)-(d) of German Application No. 10 2016 104 636.1 filed Mar. 14, 2016, 2015, the entireties of which are incorporated herein by reference.

FIELD OF THE INVENTION

The present invention relates to a chair.

BACKGROUND OF THE INVENTION

DE 10 2013 005 861 A1 discloses a chair which includes a subframe, a seat element, a back element, a spring mechanism and an adjustment device, the spring mechanism including a leaf spring which is clamped on one side in the subframe and a support which is movable on a track between the leaf spring and the subframe and the adjustment device including an adjustment member and a transmission mechanism.

Modern office premises are often increasingly utilized in such a manner that individual employees do not have a fixed workstation, but work at different workstations over the year depending on operational requirements. As a result, comparatively often the employees have to adjust a chair that is available at the respective workstation to their individual requirements. The operation is time-consuming and is consequently often ignored such that an individual employee may possibly sit on an insufficiently adjusted chair for extended periods and, as a result, may suffer from health problems in the long term.

SUMMARY OF THE INVENTION

It is the object of the present invention to propose a chair which is rapidly adjustable to individual requirements by different users.

Corresponding to the present invention, a movement of the adjustment member is translated into a movement of the support at a transmission ratio of between 1:0.5 and 1:4. As a result, it is possible for a user to perform an adjustment of the chair with minimal time expended. It is consequently possible for even a very light user to convert a chair that has been adjusted to a very heavy user optimally to his requirements in a short time.

It is provided that the track is realized as a curved surface which is adapted in such a manner to a curved progression of the respectively associated leaf spring that a movement space, realized between the track and a bottom surface of the leaf spring, permits movement of the support, unobstructed by the leaf spring, between a basic position of the support and an end position of the support, insofar as the rear swing arm is free of a load produced by a user leaning back against the back element and that a distance measured in each case in the radial direction between the track and the associated leaf spring is constant in the entire movement space. As a result of providing a space of this type for the support, the friction forces, which the support has to overcome when it moves between its different positions, can be reduced to a minimum, such that the support is able to be slid into all positions with little effort required and, when the back element is loaded, the leaf spring is placed without any considerable delay onto the support such that the support force preselected by the respective position of the support is available virtually immediately.

It is additionally provided to realize the adjustment member as a shaft or linear guide mechanism and to provide the chair with a drive for moving the adjustment member, the transmission mechanism including a rod assembly and/or a Bowden cable and/or a gear unit, wherein the transmission mechanism is connected to the support and wherein the transmission mechanism is connected to the adjustment member. As a result, a rotational movement initiated in the adjustment member or a sliding movement initiated in the adjustment member can be converted in a technically simple manner into a movement of the support.

It is provided to realize the drive as a manual drive and to provide it with a slider or a rotary knob by means of which the adjustment member can be acted upon to adjust the support.

It is also provided to realize the drive as an electric drive and to provide the drive with an electric linear drive or with an electric rotary drive. As a result, a motor-driven adjustment of the position of the support is possible such that a manual rotary movement or sliding movement to adjust the support is not required.

In addition, it is provided to fit the electric drive with an energy storage mechanism for electric energy, wherein the electric drive includes an actuating device and/or a receiver for radio signals and wherein the chair includes, in particular, an electric generator, wherein the generator generates, in particular, energy from a relative movement which occurs between individual components of the chair when the chair is used, and feeds it into the energy storage mechanism. As a result, the chair can be made into a stand-alone device which can be conveniently adjusted by means of an actuating device, such as, for example, an electric button that is arranged within visual range, or in a remote-controlled manner, e.g. by means of a smartphone. As a result of fitting the chair with a generator, the chair, with its electric drive, is made into an item of furniture which is energy self-sufficient and which does not require any service with regard to replacing or charging its energy storage mechanism and consequently, in spite of the electric drive, does not give rise to any follow-up costs.

It is also provided that the spring mechanism includes the mentioned first leaf spring and a second leaf spring, wherein the second leaf spring supports the back element in a normal position of the chair in which the back element is free of loads produced by a sitting person, and wherein the first leaf spring, in addition to the second leaf spring, supports the back element in an operating position in which the back element is loaded by a person sitting and leaning back. As a result, it is possible to hold the back element reliably in its non-loaded position such that too strong a deformation of the first leaf spring in this position is reliably avoided and consequently a low-friction movement of the support under the first leaf spring is ensured.

In this connection, it is provided to form a spring assembly by means of the first leaf spring and the second leaf spring and to connect both of these together at a connection point, in particular, in a region in which they are fastened to the subframe, the first leaf spring comprising a tapering adjacent to the connection point. As a result, the assembly of the chair is made easier and, in addition, the shaping of the first leaf spring has a positive effect on the desired support behaviour—as has been ascertained in tests.

It is also provided to support the mentioned first leaf spring by the mentioned first support and the second leaf spring by a second support, wherein the first support is slidable under the first leaf spring and wherein the second support is either fixed under the second leaf spring or is slidable under the second leaf spring independently of the first support. As a result of the support associated with the second leaf spring, the force, at which the second leaf spring supports the back element, is able to be chosen corresponding to requirements. Where the second support is adjustable, it is possible to adapt the force at which the second leaf spring supports the back element. This is, for example, advantageous when a weight of the back element is subsequently increased, for example, as a result of attaching a headrest.

It is also provided that that the mentioned first support is adjustable by the mentioned first adjustment device and that the mentioned second support is adjustable by means of a second adjustment device. In this way, adjustment of the second support can also be carried out in a convenient manner.

It is moreover provided that the transmission mechanism comprises a pivot lever which is driven directly or indirectly by the adjustment member, that the transmission mechanism comprises a rolling-contact wheel of a toothing, which is driven directly or indirectly by the pivot lever, and that the support comprises a toothed rod, wherein the rolling-contact wheel engages with its toothing in the toothed rod of the support, and that the subframe comprises a toothed rod, wherein the rolling-contact wheel engages with its toothing in the toothed rod of the subframe. Such a transmission mechanism can be of a compact design, such that it can be easily installed in the region of a carrier of a subframe of a chair.

In addition, it is provided that the transmission mechanism comprises a connecting rod, wherein the pivot lever is connected to a first end of the connecting rod for rotation about a first rotational axis, wherein the rolling-contact wheel is connected to a second end of the connecting rod for rotation about a second rotational axis, wherein the rolling-contact wheel is pulled or pushed by the connecting rod over the toothed rod of the subframe during a rotation movement of the pivot lever and, in the process, the support located between the leaf spring and the rolling-contact wheel is entrained and moved by the rotating and moving rolling-contact wheel. Through the use of a connecting rod as an intermediate member of the transmission mechanism, the pivoting movement of the pivot lever can be converted with minimal structural complexity into a linear movement.

Through a parallel arrangement of the pivot axis of the pivot lever and of the first rotational axis of the connecting rod and the second rotational axis of the connecting rod, the structure of the transmission mechanism is kept simple and smooth-running.

It is also provided that the transmission mechanism comprises a Bowden cable or a gear unit, wherein the Bowden cable or the gear unit is connected to the adjustment member and to the pivot lever, wherein the Bowden cable or the gear unit is secured on the pivot lever eccentrically with respect to the pivot axis of the pivot lever with an eccentricity. Through the choice of the eccentricity, the transmission ratio can be easily changed and adapted to different design forms of a chair.

Finally, it is also provided that the transmission mechanism comprises a rolling-contact wheel with a toothing, wherein the rolling-contact wheel is directly or indirectly connected to the adjustment member and is pulled or pushed by means of the latter over a toothed rod of the subframe, wherein the rolling-contact wheel engages with its toothing in a toothed rod of the support and thereby entrains and moves the support located between the leaf spring and the rolling-contact wheel. Such a transmission mechanism can be of a compact design, such that it can be easily installed in the region of a carrier of a subframe of a chair.

A transmission ratio in the sense of the present invention is to be understood as both a conversion of the speed of the drive into a faster speed of the support and a conversion of the speed of the drive into an identical speed of the support, and also as a conversion of the speed of the drive into a slower speed of the support.

BRIEF DESCRIPTION OF THE DRAWINGS

Further details of the present invention are described in the drawing by way of schematically shown exemplary embodiments.

DETAILED DESCRIPTION OF THE INVENTION

Figure 1:
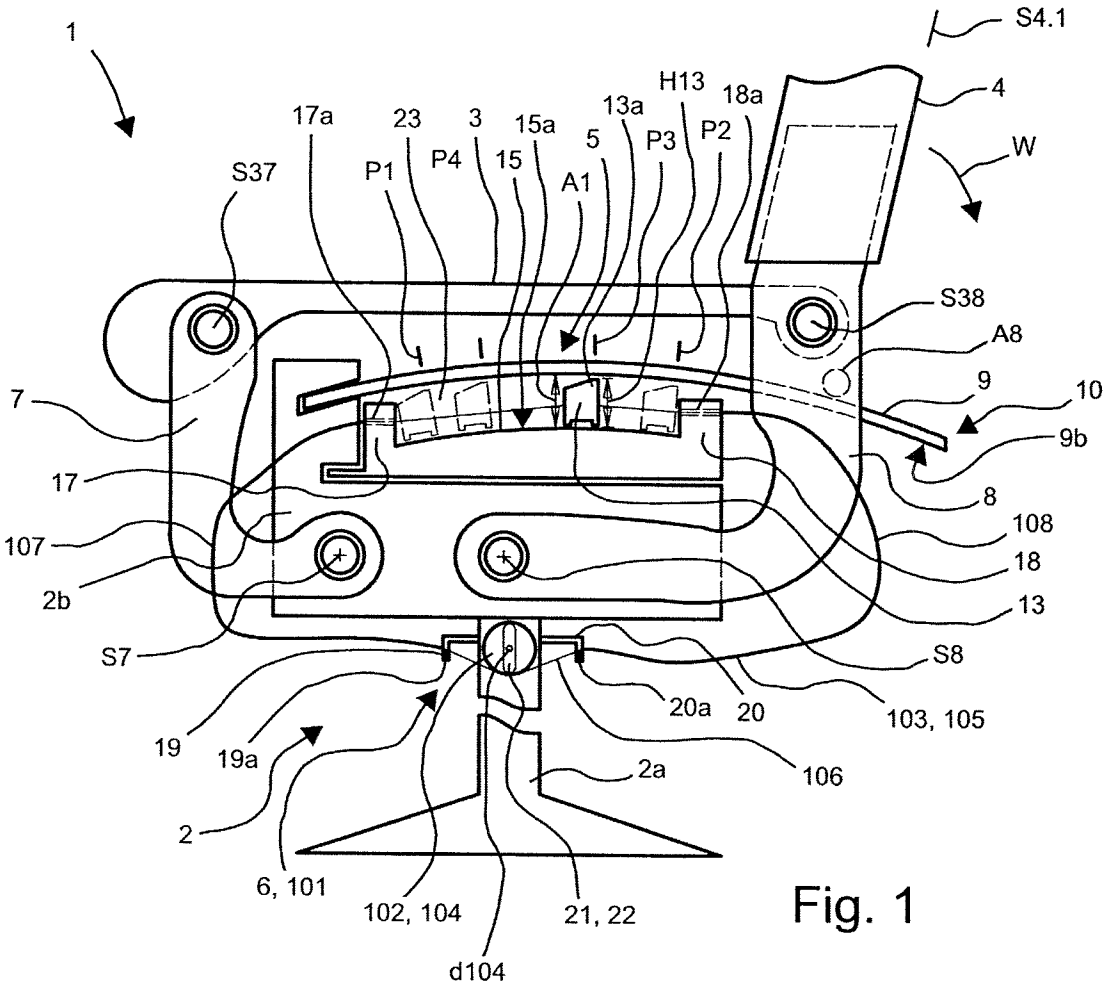
FIG. 1 shows a schematic side view of a first realization variant of a chair according to the present invention.

FIG. 1 shows a schematic side of a chair 1 which includes a subframe 2, a seat element 3, a back element 4, a spring mechanism 5 and an adjustment device 6. The subframe 2 includes a base element 2*a* and a carrier 2*b*. The chair 1 additionally includes a front swing arm 7 and a rear swing arm 8 which is realized as a back connection. In this connection, the base element 2*a* is connected to the carrier 2*b*. The back element 4 is pivotally mounted on the carrier 2*b* by means of the swing arm 8 and, in addition, the seat element 3 is pivotally mounted on the carrier 2*b* by means of the front swing arm 7. The front swing arm 7 is connected to the carrier 2*b* so as to be pivotable about a pivot axis S7 and the rear swing arm 8 is connected to the carrier 2*b* so as to be pivotable about a pivot axis S8. The seat element 3 is connected to the swing arm 7 so as to be pivotable about a pivot axis S37. In addition, the seat element 3 is connected to the back connection 8 so as to be pivotable about a pivot axis S38. The seat element 3 and the back element 4 are connected together so as to be rotatable by means of the pivot axis S38. The carrier 2*b* receives the spring mechanism 5.

Figure 2:
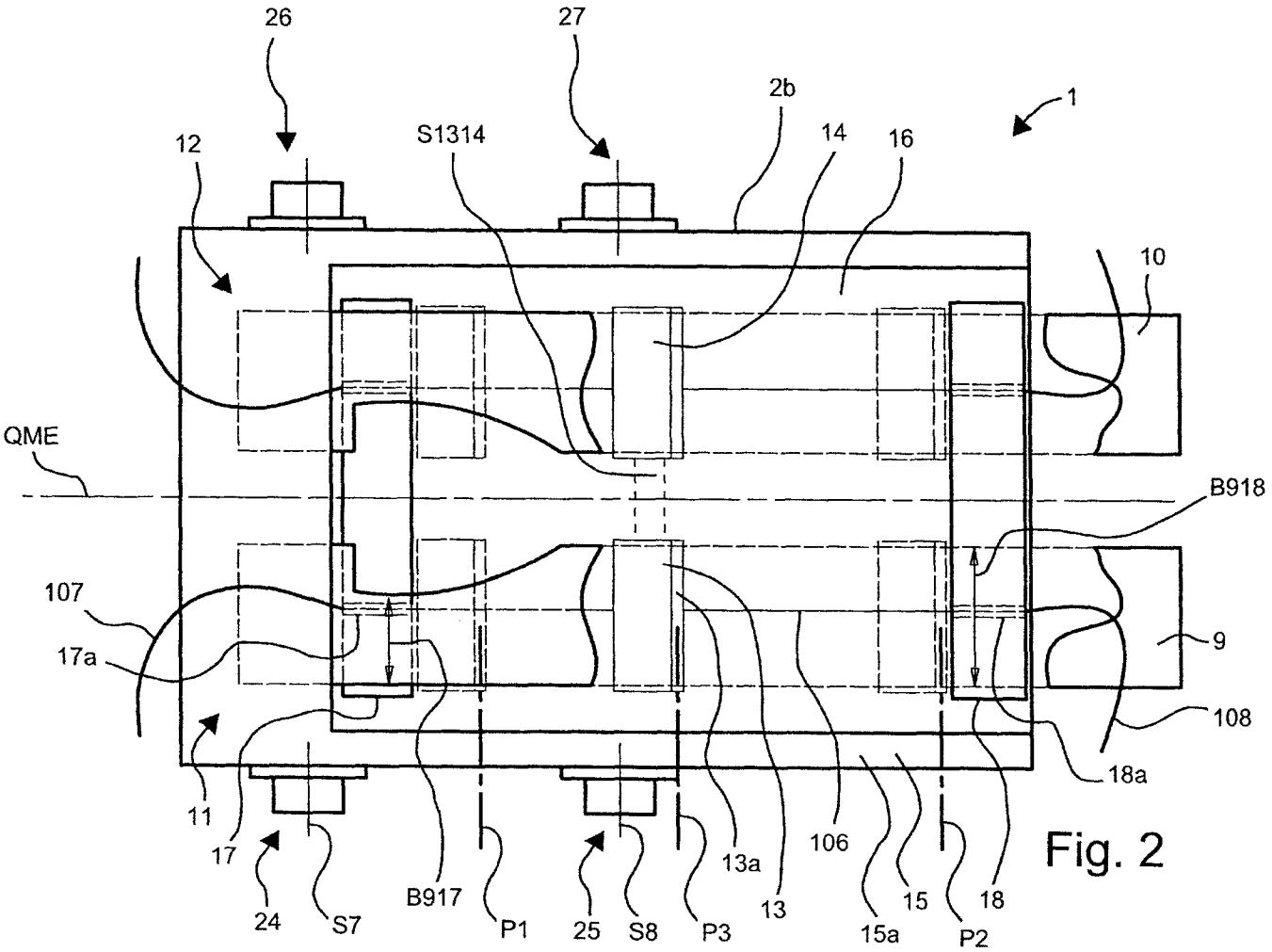
FIG. 2 shows a schematic top view of the first realization variant of the chair according to the present invention with the back element blanked out and the seat element blanked out.

FIG. 2 shows a schematic top view of the first realization variant of the chair 1 according to the present invention with the back element blanked out and with the seat element blanked out. It can be seen from the top view that the chair 1 is realized in a substantially mirror-symmetrical manner with respect to a transverse centre plane QME. Substantially the region of the chair 1 that in the representation in FIG. 2 is located below the transverse centre plane QME, which is marked by a broken line, is described in a corresponding manner below. Nevertheless, reference is also made again and again to components located above the transverse centre plane QME which are completely hidden, as a rule, in the side view.

The carrier 2*b* includes a leaf spring 9 and a leaf spring 10, which is hidden by the leaf spring 9 in the view in FIG. 1. As can be seen in FIG. 2, the leaf springs 9, 10 are clamped on one side in the receiving mechanism 11, 12 of the carrier 2*b*. In addition, the spring mechanism 5 includes two supports 13, 14, tracks 15, 16, a front stop 17 and a rear stop 18. The supports 13, 14 are movable on the tracks 15 or 16 under the leaf spring 9 or 10 between a front position or normal position P1 marked by way of the broken line and a rear position or end position P2 marked by a broken line, such that the leaf spring 9 or 10 supports a tilting back of the back element 4 in a direction of rotation w (see FIG. 1), which is caused by a person leaning back against the back element 4, by means of the rear swing arm 8 which is supported by way of a stop A8 on the leaf springs 9 and 10.

By means of the adjustment device 6, the support 13, which is in a centre position P3 shown by way of continuous lines, is movable as an option into the named extreme position P1, in which the support 13 causes the leaf springs 9 to provide the back element 4 with only a small amount of support, into the named extreme position P2 in which the support 13 causes the leaf springs 9 to provide the back element 4 with a large amount of support, and into all positions lying in between that are not marked in any more detail. In this connection, the centre position P3 of the supports 13, 14 shown in FIG. 2 does not concur completely with the centre position P3 shown in FIG. 1. A fourth position P4 lying between the positions P1 and P3 is marked as an example by way of broken lines in FIG. 1 as further position P4.

The adjustment device 6 is realized as a mechanical adjustment device 101 and includes an adjustment member 102 and a transmission mechanism 103. The adjustment member 102 is realized as a shaft 104 which is rotatable about a rotational axis d104, and the transmission mechanism 103 is realized as a Bowden cable 105. In this connection, the Bowden cable 105 includes a wire cable 106 and two sleeves 107, 108. The wire cable 106 is fixed on the support 13 and is run between the track 15 and the leaf spring 9 through a through-bore 17*a* of the front stop 17. In addition, the wire cable 106 extends through the first sleeve 107 which is laid between the front stop 17 and a first holder 19 by way of a through-bore 19*a*. The wire cable 106 then leaves the first sleeve 108, runs through the through-bore 19*a* and wraps around the shaft 104 that forms the adjustment member 102 in order then to enter through a through-bore 20*a* of a second holder 20 into the second sleeve 108 which is laid between the second holder 20 and the rear stop 18. The wire cable 106 then leaves the second sleeve 108 through a through bore 18*a* realized in the rear stop 18 and runs between the track 15 and the leaf spring 9 to the support 13 on which it is fixed. The two holders 19 and 20 are fixed on the base element 2*a*.

A drive 21 for the adjustment device 101 is formed by a rotary knob 22 which is connected to the adjustment member 102 that is realized as the shaft 104. As a result of rotating the rotary knob 22 to the left about the rotational axis d104, the support 13 is pulled by the wire cable 106 out of its position P3 in the direction of the position P1 or P3. As a result of rotating the rotary knob 22 to the right about the rotational axis d104, the support 13 is pulled by the wire cable 106 out of its position P3 in the direction of the position P2. Here, a diameter of the shaft 104, over which the wire cable 106 is guided, is chosen such that about 1.5 revolutions of the shaft 104 are sufficient to move the support 13 from the position P1 to the position P2. To this extent, there is here a transmission ratio of about 1:0.7.

In a non-loaded position S4.1 (see FIG. 1) of the back element 4, in which the back element 4 is not loaded by a person leaning back, a top surface 15*a* of the track 15 and a bottom surface 9*b* of the leaf spring 9 are matched to one another in such a manner that between them is formed a space 23 which permits displacement of the support 9 from its position P1 into its position P2 without it grinding against the bottom surface 9*b* of the leaf spring 9 with its head 13*a* and as a result being braked. In other words, this means that a distance A that is measured radially with respect to a respective curvature of the track 15 between the top surface 15*a* of the track 15 and the bottom surface 9*b* of the leaf spring 9 is greater than a maximum height H13 of the support 13. This ensures that, in the non-loaded position S4.1 of the back element 4, the support 13 can be moved by the adjustment device 6 or 101 in an unobstructed manner between the position P1 and the position P2 such that the support 13 is able to be positioned at an expenditure of force which is free of braking forces resulting from the weight of a person.

The first realization variant shown in FIGS. 1 and 2 obviously also includes an adjustment device for the support 14. In this connection, it is provided according to a first realization variant to realize the adjustment device in an analogous manner to the adjustment device described and to connect the shafts of the two adjustment devices together such that both supports are adjustable together as an option by one of the rotary knobs. According to a second realization variant, it is also provided to wrap the wire cable of the Bowden cable of the second adjustment device also about the shaft of the first adjustment device such that both supports are able to be moved by means of the shaft of the first adjustment device.

According to a further realization variant, it is also provided—as marked in FIG. 2 by way of broken lines—to connect the two supports 13, 14 by means of a web S1314 and to provide an adjustment device which is coupled to the web S1314 such that the two supports 13, 14 are moved together by the web S1314.

As can be seen from the representation in FIG. 2, the leaf springs 9, 10 are realized in each case tapering toward the receiving mechanism 11, 12 such that a width B918, which the leaf spring 9 comprises in the region of the rear stop 18, is at least 1.5 times greater than a width B9017, which the leaf spring 9 comprises in the region of the front stop 17. Two lugs 24, 25 and 25, 27 are arranged in each case at the side of the carrier 2*b*, by means of which lugs the pivot axes S7, S8 the swing arms 7, 8 of the chair 1 are formed.

Figure 3:
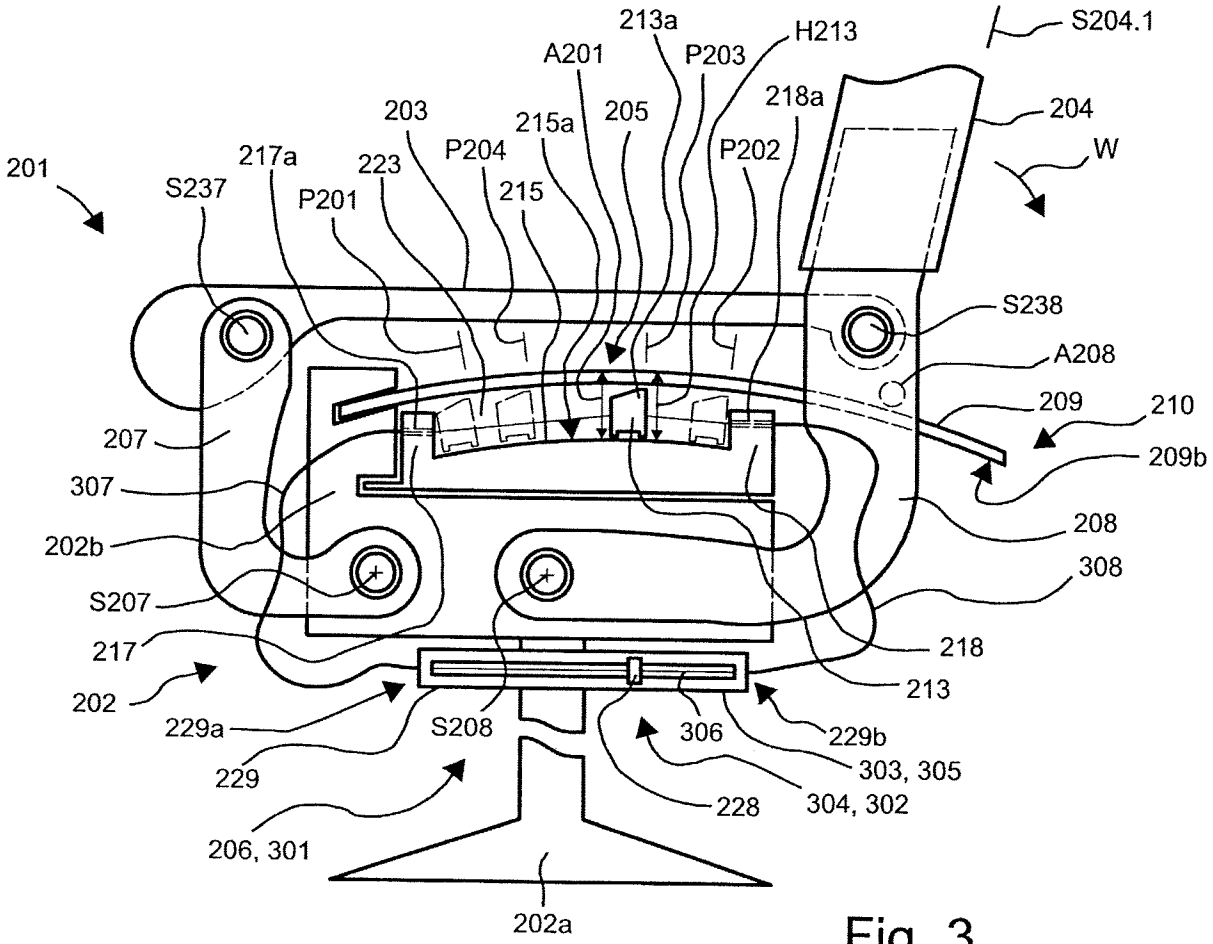
FIG. 3 shows a schematic side view of a second realization variant of a chair according to the present invention.

FIG. 3 shows a second realization variant of a chair according to the present invention as the chair 201. Reference is initially made to the description regarding the chair 1 shown in FIG. 1, the comparable reference numerals from the numeral series 1 to 99 being increased in each case by 200. The adjustment device 206 is also realized as a mechanical adjustment device 301, but has a different technical design.

The adjustment device 301 includes an adjustment member 302 and a transmission mechanism 303. The adjustment mechanism 302 is realized as a linear guide 304 and the transmission mechanism 303 is realized as a Bowden cable 305. In this connection, the Bowden cable 305 includes a wire cable 306 and two sleeves 307, 308. The wire cable 306 is fixed on the support 213 and is run between the track 215 and the leaf spring 209 through a through-bore 217*a* of the front stop 217. In addition, the wire cable 306 extends through the first sleeve 307 which is laid between the front stop 217 and a linear guide housing 229. The wire cable 306 leaves the first sleeve 308 and runs through an inlet bore 229*a* into the linear guide housing 229 and is guided by the linear guide 304 forming the adjustment member 302 in order then to enter through an outlet bore 229*b* of the linear guide housing 229 into the second sleeve 308 which is laid between the second holder 220 and the rear stop 218. The wire cable 306 then leaves the second sleeve 308 through a through-bore 218*a* realized in the rear stop 218 and runs between the track 215 and the leaf spring 209 to the support 213 on which it is fixed.

A drive 221 for the adjustment device 301 is formed by a slider 228 which is guided in the linear guide 304 forming the adjustment member 302 and is fixedly connected to the wire cable 306. As a result of sliding the slider 228 to the left, the support 213 is pulled by the wire cable 306 to the right out of its position P203 in the direction of the position or end position P202. As a result of sliding the slider 228 to the right, the support 213 is pulled to the left by the wire cable 306 out of its position P203 in the direction of the position or normal position P201.

In the top view, the second realization variant of the chair shown in FIG. 3 corresponds to FIG. 2.

Figure 4:
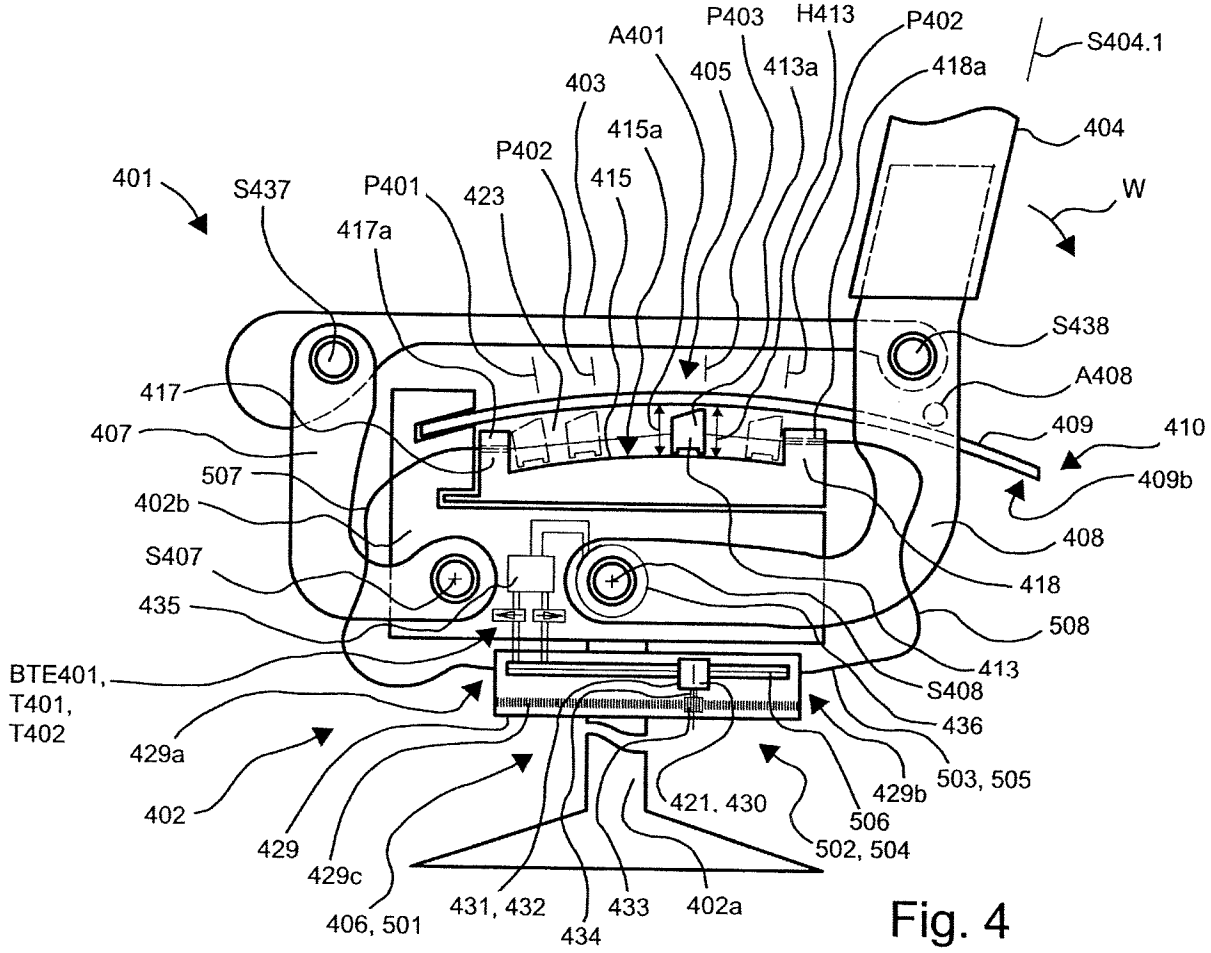
FIG. 4 shows a schematic side view of a third realization variant of a chair according to the present invention.

FIG. 4 shows a third realization variant of a chair according to the invention as the chair 401. Reference is initially made to the description regarding the chair 1 shown in FIG. 1, the comparable reference numerals from the numeral series 1 to 99 being increased in each case by 400. The adjustment device 406 is realized as an electro-mechanical adjustment device 501.

The adjustment device 501 includes an adjustment member 502 and a transmission mechanism 503. The adjustment mechanism 502 is realized as a linear guide 504 and the transmission mechanism 503 is realized as a Bowden cable 505. In this connection, the Bowden cable 505 includes a wire cable 506 and two sleeves 507, 508. The wire cable 506 is fixed on the support 413 and is run between the track 415 and the leaf spring 409 through a through-bore 417*a* of the front stop 417. In addition, the wire cable 506 extends through the first sleeve 507 which is laid between the front stop 417 and a linear guide housing 429 by way of an inlet bore 429*a*. The wire cable 506 then leaves the first sleeve 508, runs through the inlet bore 429*a* into the linear guide housing 429 and is guided by the linear guide 504 forming the adjustment member 502 in order then to enter through an outlet bore 429*b* of the linear guide housing 429 into the second sleeve 508 which is laid between the linear guide housing 429 and the rear stop 418. The wire cable 506 then leaves the second sleeve 508 through a through-bore 418*a* realized in the rear stop 418 and runs between the track 415 and the leaf spring 409 to the support 413 on which it is fixed.

A drive 421 for the adjustment device 501 is formed by an electric drive 430 which is guided in the linear guide 504 forming the adjustment member 502. To this end, the electric drive 430 is realized with part of its housing 431 as a slider 432. The electric drive 430 includes a toothed wheel 433 which it drives by way of its motor shaft 434. The linear guide housing 429 includes a toothed rod 429*c* in which the electric drive 430 engages by way of its toothed wheel 433. In dependence on a direction of rotation of the toothed wheel 433, the electric drive 430, which is guided in the linear guide 504, can be moved to the left or the right in the linear guide 504. As a result of moving the electric drive 430 to the left, the support 413 is pulled to the right by the wire cable 506 out of its position P403 in the direction of the position or end position P402. As a result of moving the electric drive 430 to the right, the support 413 is pulled by the wire cable 506 to the left out of its position P403 in the direction of the position or normal position P401. Two keys T401-1 and T401-2 are arranged on the carrier 402*b* of the chair 401. The keys are arranged in a power circuit between a rechargeable energy storage mechanism 435 and the electric drive 430. As a result of actuating the key T401-1, the support 413 is moved forward and as a result of actuating the key T401-2, the support is moved rearward. In this connection, the two keys form an actuating device BTE401. As an option, the chair 401 also includes an electric generator 436 which generates electric energy as a result of a relative movement between the lug 425 (see FIG. 5) and the rear swing arm 40 and feeds it into the rechargeable energy storage mechanism 435.

Figure 5:
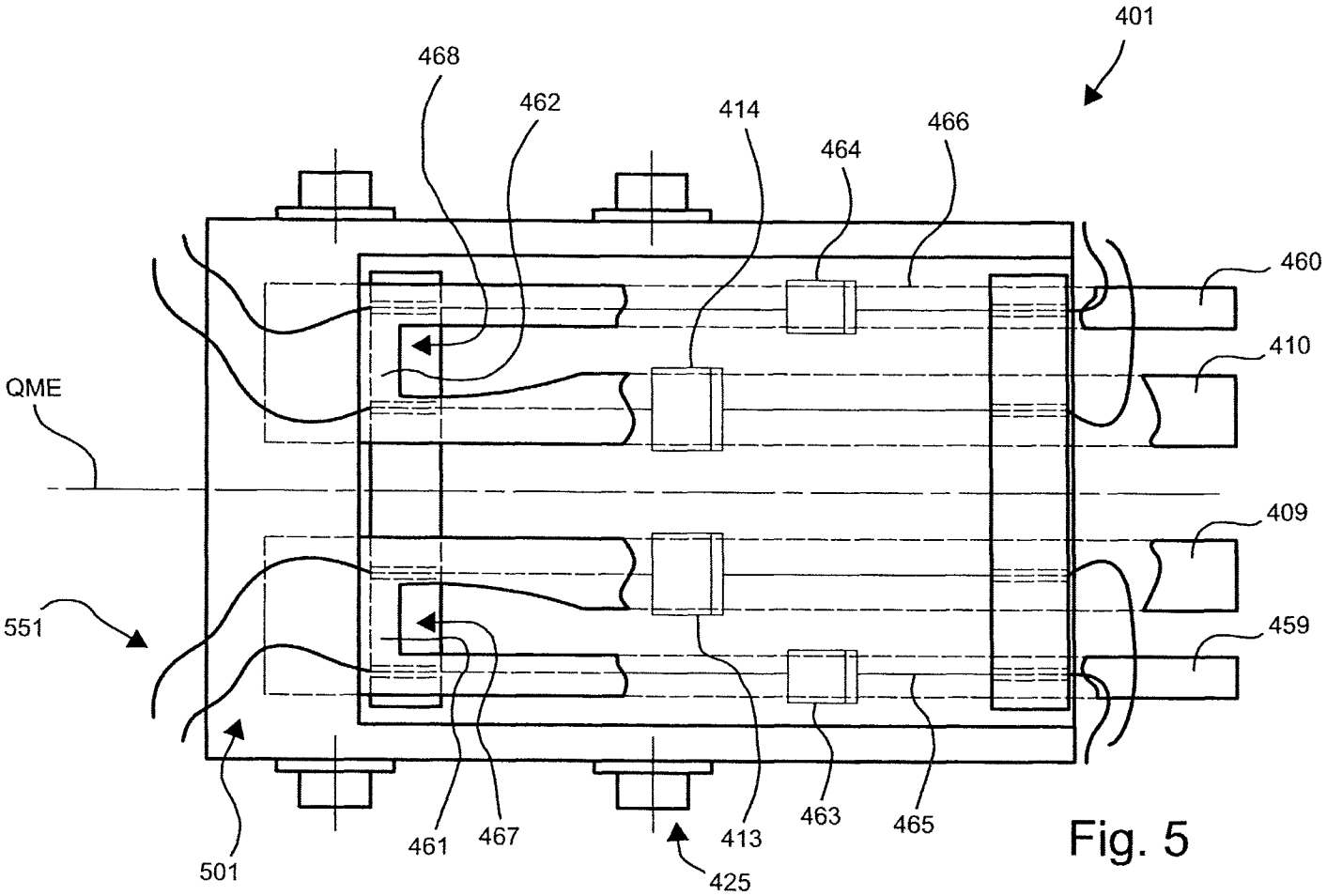
FIG. 5 shows a schematic top view of the third realization variant of the chair according to the present invention with the back element blanked out and the seat element blanked out.

FIG. 5 shows a schematic top view of the third realization variant of the chair 401 according to the invention with the back element blanked out and with the seat element blanked out. It can be seen from the top view that the chair 401 is realized in a substantially mirror-symmetrical manner with respect to a transverse centre plane QME. Substantially the region of the chair 1 that is located in the representation in FIG. 2 below the transverse centre plane QME which is marked by a broken line is described in a corresponding manner below. Nevertheless, reference is also made again and again to components located above the transverse centre plane QME which are completely hidden, as a rule, in the side view.

Along with the first leaf springs 409, 410, the spring mechanism 405 includes second leaf springs 459 and 460. The first leaf spring 410 and the second leaf spring 459 form a spring assembly 461. The first leaf spring 410 and the second leaf spring 459 form a further spring assembly 462. An own support 463 or 464 is assigned in each case to the second leaf springs 459 and 460. In this connection, the second leaf springs 459, 460 serve for the purpose of supporting the back element 404 (see FIG. 4) in its initial position or normal position or starting position S404.1, in which it is shown in FIG. 4 and in which it is not loaded by a person leaning back, such that the supports 413 or 414 assigned to the first leaf springs 409, 410 are able to be moved in a non-obstructed manner by the first leaf springs 409, 410 between their extreme positions P401 and P402 when the chair 410 is not loaded or when a user only loads the seat element 3 without loading the back element 4.

In FIG. 5, further Bowden cables 465, 466, which are assigned to the supports 463 and 464, indicate that the supports 463, 464 are also able to be adjustable as an option. As a result, fine-adjustment of the chair 401 is made possible, by way of which the spring force of the leaf spring 459 or 460 is able to be readjusted.

As shown in FIG. 5, it is also provided that the leaf springs 409 and 459 or 410 and 460, which form the spring assemblies 461 and 462, are connected at connection points 467, 468 and form the respective one-piece spring assemblies 461 and 462. In this connection, the first leaf springs 409 or 410 of the spring assemblies 461 or 462 are in particular realized in a tapered manner adjoining the connection points 467 or 468. With regard to an adjustability of the supports 413, 414, which are arranged under the leaf springs 409, 410, reference is made to the description concerning FIG. 2. The support 413 is adjustable by means of the first adjustment device 501 and the second support 463 is adjustable, insofar as adjustability is provided, by means of a second adjustment device 551.

It is obviously possible to combine each of the three designs of the chair shown in FIGS. 1, 3 and 4 with each of the two designs shown in FIGS. 2 and 5, at least one adjustment device being provided in each case.

Figure 6:
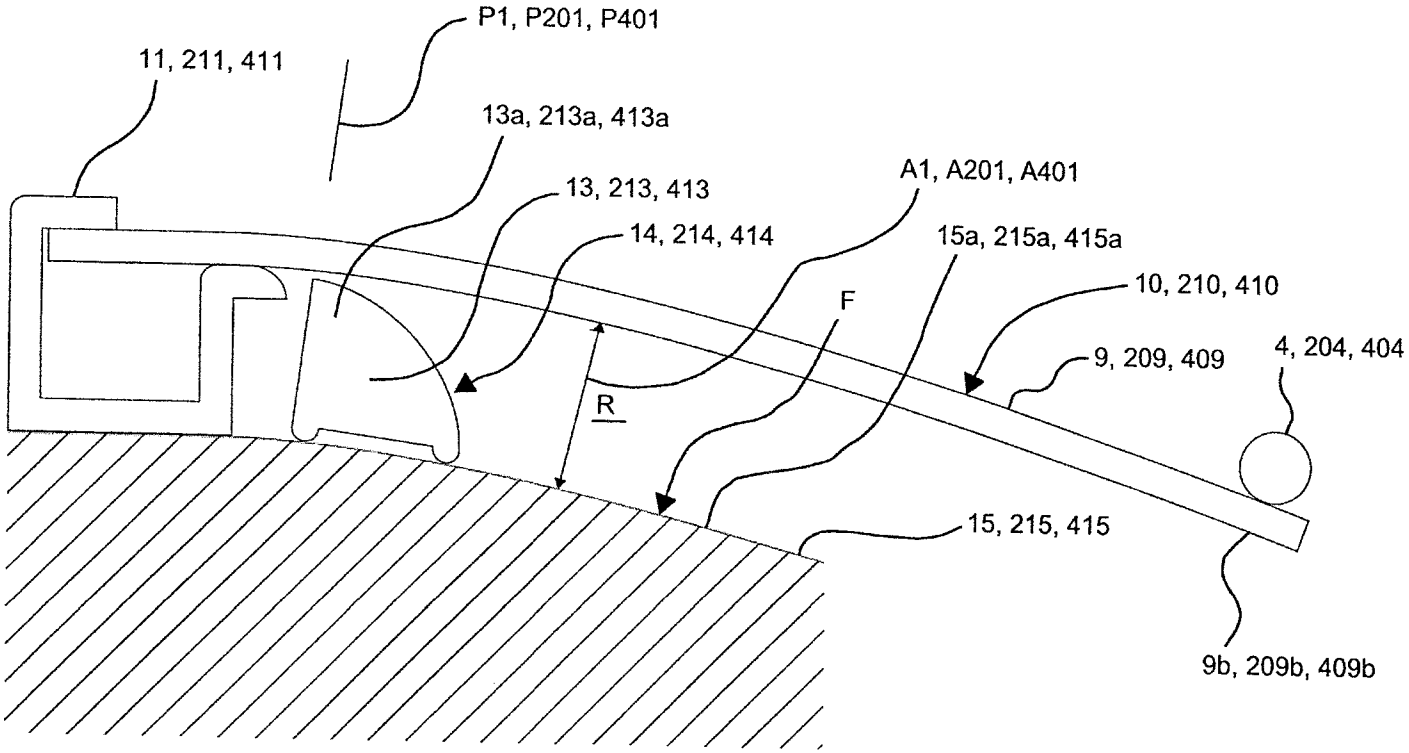
FIGS. 6 and 7 show schematic representations of a support located between a leaf spring and a track.
Figure 7:
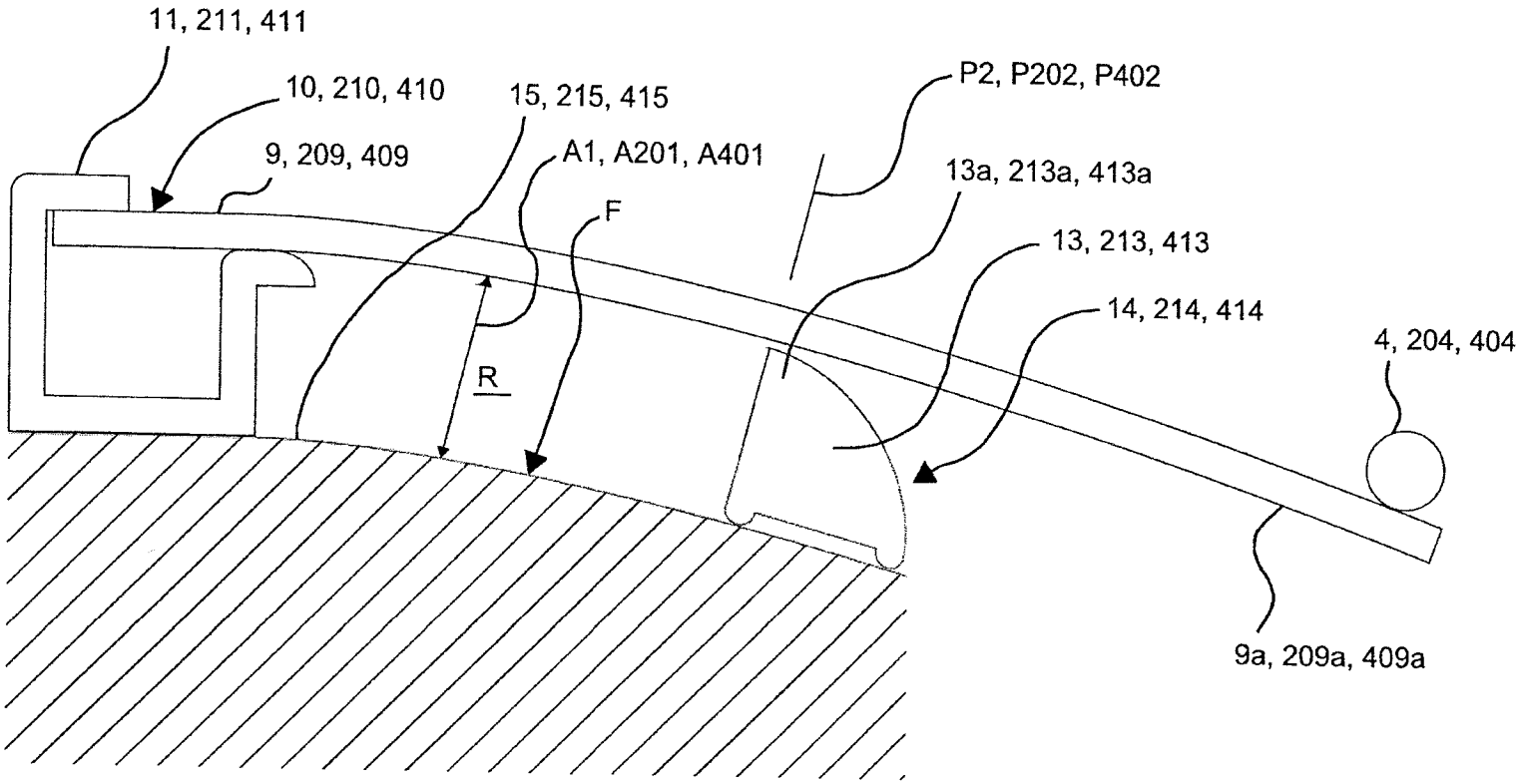

In FIGS. 6 and 7, in schematic views with reference to FIGS. 1, 3 and 4, it is shown that the tracks 15, 215, 415 comprise a curved progression which is adapted to a curved progression of the leaf springs 9, 10 or 209, 210 or 409, 410. In this connection, the adaptation is performed such that the support 13 or 213 or 413 or 14 or 214 or 414, which is situated initially close to the receiving mechanism 11 or 211 or 411 for the leaf springs 9, 10 or 209, 210 or 409, 410, is able to be moved out of a position P1 or P201 or P410 shown in FIG. 6 into a position P2 or P202 or P402 shown in FIG. 7 without the support 13 or 213 or 412 being obstructed or braked by the leaf spring 9 or 209 or 409 during its movement. Located opposite the receiving mechanism 11 or 211 or 411, the back element 4 or 204 or 404, which is supported in its normal position on the leaf spring 13 or 213 or 413, is symbolized in each case by way of a circle. As soon as the back element 4 or 204 or 404 is loaded by a person leaning back, the leaf spring 9 or 209 or 409 is placed onto the head 13*a* or 213*a* or 413*a* of the support 13 or 213 or 413. At this moment, the support 13 or 213 or 413 is in a position which produces the desired spring force of the leaf spring 9 or 209 or 409. By way of its top surface 15*a* or 215*a* or 415*a*, the track 15 or 215 or 415 consequently forms a curved surface F which is adapted in such a manner to a curved progression of the respectively assigned leaf spring 9 or 209 or 409 that a movement space R that is formed between the track 15 or 215 or 415 and the bottom surface 9*b* or 209*b* or 409*b* permits movement of the support 13 or 213 or 413, unobstructed by the leaf spring 9 or 209 or 409, between the first position P1 or P201 or P401 of the support 13 or 213 or 413 and the second position P2 or P202 or P402 of the support 13 or 213 or 413 insofar as the back element 4 or 204 or 404 is free from a load produced by a user leaning back against the back element 4 or 204 or 404. In addition, a distance A1 or A201 or A401 that is measured in each case in the radial direction between the track 16 or 216 or 416 and the assigned leaf spring 9 or 209 or 409 is constant in the entire movement space R.

Figure 8:
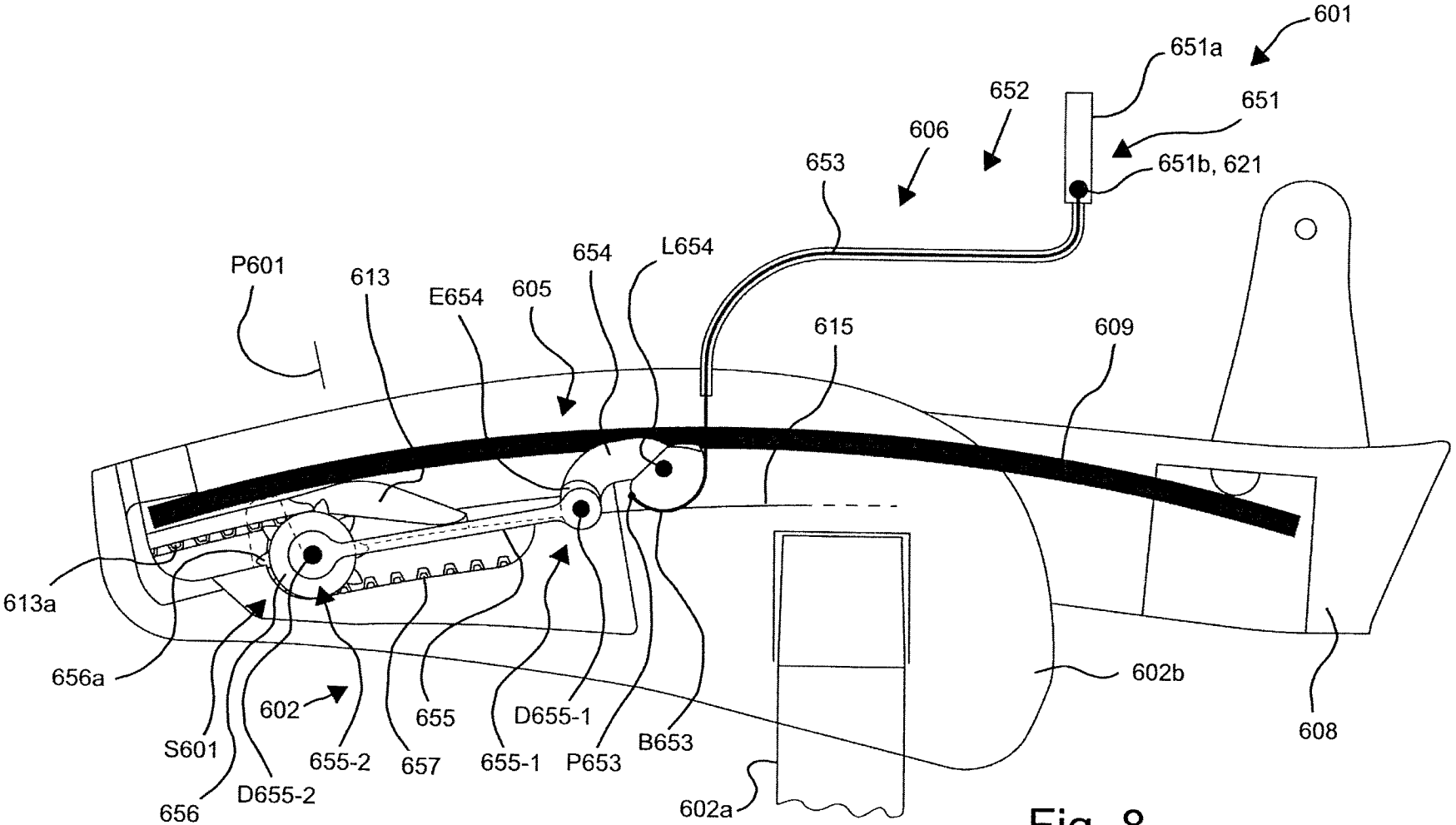
FIGS. 8 and 9 show schematic side views of a fourth realization variant of a chair according to the present invention, in a setting for persons of light weight and in a setting for persons of heavy weight.
Figure 9:
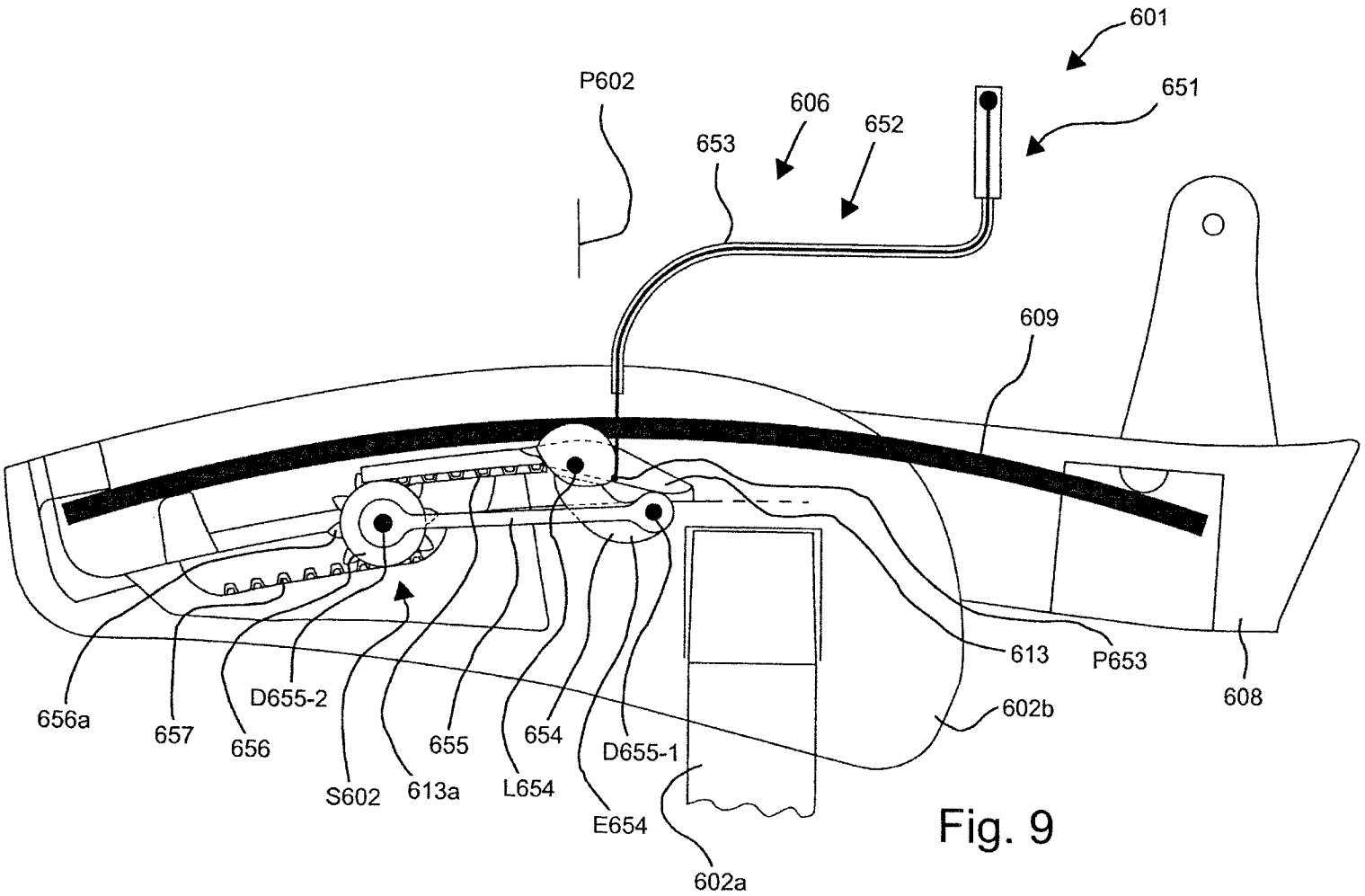
Figure 10:
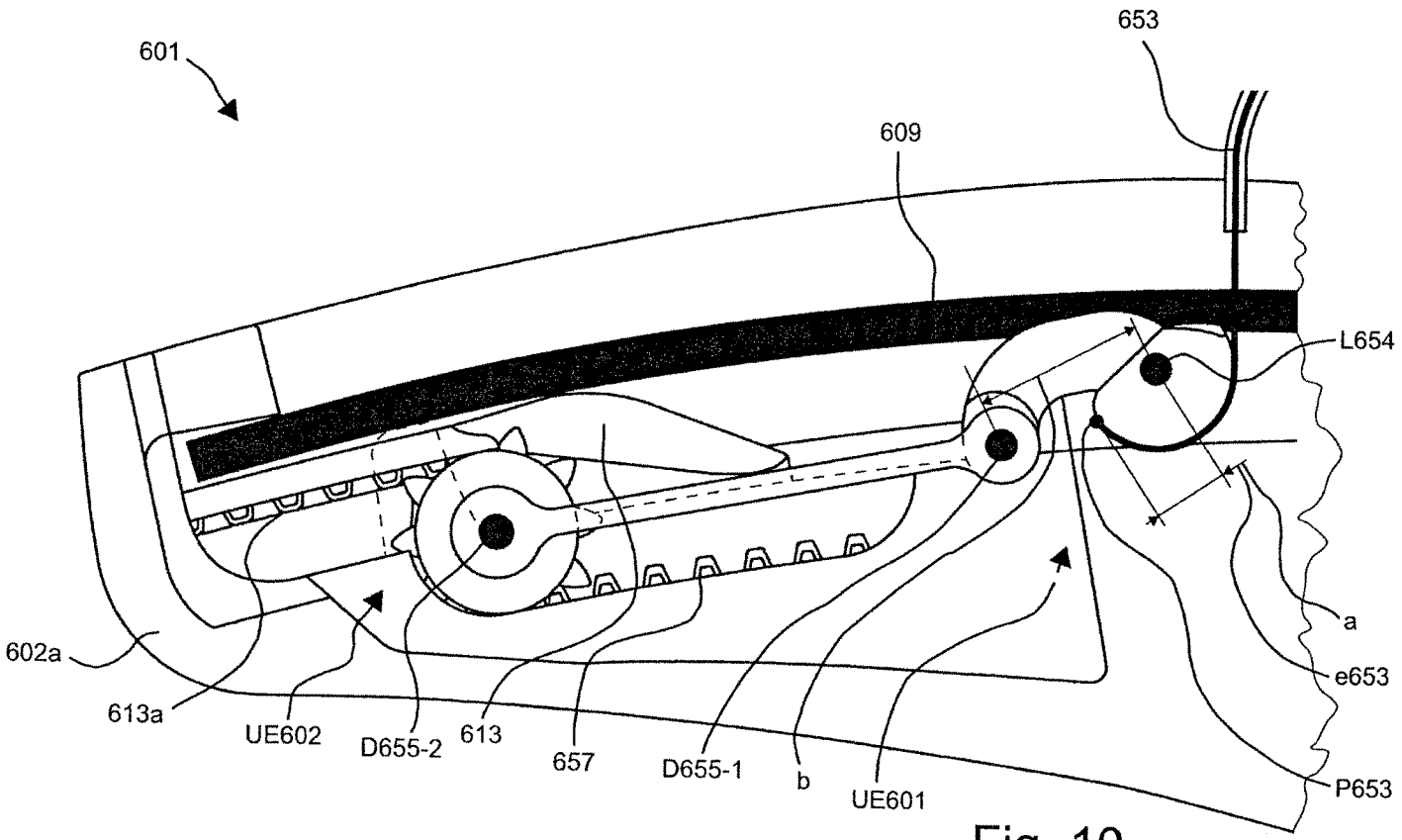
FIGS. 10 and 11 show details from FIGS. 8 and 9.
Figure 11:
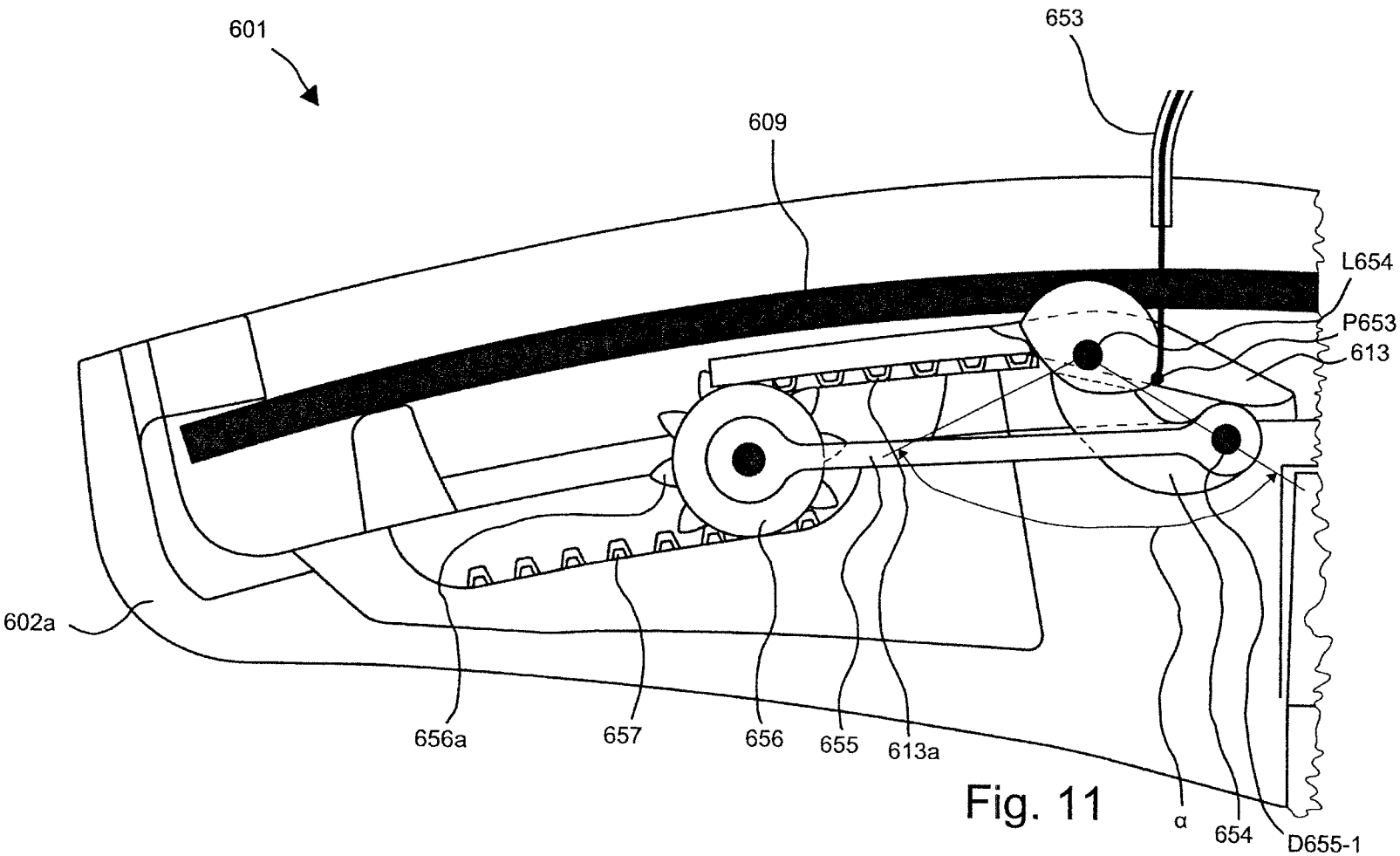

FIGS. 8 to 11 show two schematic side views, and details of these side views, of a fourth realization variant of a chair 601 according to the present invention, in a setting for persons of low weight (FIGS. 8, 10) and a setting for persons of heavy weight (FIGS. 9, 10).

The chair 601 comprises an only partially indicated subframe 602. Analogously to the realization variant shown in FIG. 1, a seat element (not shown) and a back element (not shown) are articulated on this subframe 602. Moreover, the chair 601 comprises a spring mechanism 605 and an adjustment device 606. The subframe 602 comprises a partially indicated base element 602*a* and a carrier 602*b*. The chair 1 also comprises a rear swing arm 608 which is designed as a back connection and which bears on a leaf spring 609 clamped into the subframe 602. A pretensioning of the leaf spring 609 is determined by the positions P601, P602 which are adopted by a support 613 on a track 615 located between the leaf spring 609 and the subframe 602 (compare FIGS. 8 and 9). In FIG. 8, the support 613 stands in the forward position P601, which is also designated as a basic position, and, in FIG. 9, the support 613 stands in a rear position P602, which is also designated as an end position. In the forward position P601 of the support 613, the swing arm 608 for supporting the back element (not shown) against a person leaning back acquires only relatively weak support by the leaf spring 609 and is thus set for persons of light body weight, e.g. under 50 kg. In the rear position P602 of the support 613, the swing arm 608 for supporting the back element (not shown) against a person leaning back acquires only relatively strong support from the leaf spring 609 and is thus set for persons of heavy body weight, e.g. over 90 kg. By means of the adjustment device 606, the support 613 can be moved from the basic position P601 to the end position P602 and back and can also be moved to each intermediate position lying between these positions P601, P602. The adjustment device 606 comprises an adjustment member 651 and a transmission mechanism 652.

The adjustment member 651 comprises a linear guide 651*a* and a slider 651*b*. The transmission mechanism 652 comprises a Bowden cable 653, a pivot lever 654, a connecting rod 655 and a rolling-contact wheel 656 with a toothing 656*a*. The pivot lever 654 is mounted pivotably on the carrier 602*b* of the subframe 602 about a pivot axis L654 and can be pivoted about a pivot angle $\alpha$ of over 90° by the adjustment member 651 by means of the Bowden cable 653, which is connected to the adjustment member 651 and to the pivot lever 654. Here, the Bowden cable 653, which can be actuated by hand by means of the slider 651*b* serving as drive 621, engages, eccentrically to the pivot axis L654, in a point of engagement P653 on the pivot lever 654 and is guided on the pivot lever 654 on a track B653 extending in a circle about the pivot axis L654. A free end E654 of the pivot lever 654 is connected to a first end 655-1 of the connecting rod 655 for rotation about a rotational axis D655-1. From a relationship in which there is a first distance a (see FIG. 10) between the pivot axis L654 and the point of engagement P654 and a second distance b (see FIG. 10) between the pivot axis L654 and the rotational axis D655-1, there derives a first transmission ratio UE601 with which the movement of the adjustment member 651 or of the Bowden cable 653 is converted by means of the pivot lever 654 into a movement of the connecting rod 655. In the embodiment shown, the first transmission ratio UE601 is about 1:2.

At a second end 655-2 of the connecting rod 655, the rolling-contact wheel 656 with its toothing 656*a* is arranged rotatably about a rotational axis D655-2. The rolling-contact wheel 656 is freely rotatable about the rotational axis D655-2 with respect to the connecting rod 655. The rolling-contact wheel 656 lies on a toothed rod 657, which is formed on the carrier 602*b* of the subframe 602. During a pivoting movement of the pivot lever 654 to the left about the pivot axis L654, the rolling-contact wheel 656 is pulled by the connecting rod 655 over the toothed rod 657 and in this case rolls along the latter. Lying opposite the toothed rod 657 is the support 613, which comprises a toothed rod 613*a* in which the rolling-contact wheel 656 likewise engages with its toothing 656*a*. If the rear swing arm 608 of the chair 601 is unloaded, the support 613 can be freely moved by the leaf spring 609 below the latter. Here, the rolling-contact wheel 656 interacts with the support 613 and the toothed rod 613*a* thereof in such a way that the rolling-contact wheel 656, e.g. in a movement perpendicular to the course and in the direction of the pivot axis L654 of the pivot lever 654, entrains the support 613 in the direction of the pivot axis L654 and at the same time as far as the pivot axis L654. Accordingly, the support 613 moves twice as fast and twice as far as the connecting rod 655. Thus, there is a second transmission ratio UE602 of 1:2, and a total transmission ratio of 1:4 is therefore obtained. If the rolling-contact wheel 656 is moved away from the pivot axis L654 from its position S602, which it occupies when the support 613 stands in the position P602, by means of a clockwise rotation of the pivot lever 654 about the pivot axis L654, the support 613 is also moved away from the pivot axis L654 and conveyed away, such that it is again in the position P601 at the end of the pivoting movement. The rolling-contact wheel 656 is then in a position S601 (see FIG. 8).

LIST OF REFERENCES

1 Chair
2 Subframe
2*a* Base element
2*b* Carrier
3 Seat element
4 Back element
5 Spring mechanism
6 Adjustment device
7 Front swing arm
8 Rear swing arm
9 Leaf spring
9*b* Bottom surface of 9
10 Leaf spring
11 Receiving mechanism for 9 on 2*b*
12 Receiving mechanism for 10 on 2*b*
13 Support
13*a* Head of 13
14 Support
15 Track
15*a* Top surface of 15
16 Track
17 Front stop
17*a* Through-bore
18 Rear stop
18*a* Through-bore
19 First holder
19*a* Through-bore
20 Second holder
20*a* Through-bore
21 Drive
22 Rotary knob
23 Space between 15 and 9
24, 25 Lug on 2*b*
26, 27 Lug on 2*b*
A1 Distance between 15 and 9
A8 Stop on 8
H13 Height of 13
P1 Normal position/front position of 13
P2 End position/rear position of 13
P3 Centre position of 13
P4 Further position of 13
S7 Pivot axis
S8 Pivot axis
S37 Pivot axis
S38 Pivot axis
S1314 Web between 13 and 14
QME Transverse centre plane
F Curved surface
R Movement space
w Direction of rotation
101 Adjustment device
102 Adjustment member
103 Transmission mechanism
104 Shaft
105 Bowden cable
106 Wire cable
107, 108 Sleeve
d104 Rotational axis of 104
201 Chair
202 Subframe
202*a* Base element
202*b* Carrier
203 Seat element
204 Back element
205 Spring mechanism
206 Adjustment device
207 Front swing arm
208 Rear swing arm
209 Leaf spring
209*b* Bottom surface of 209
210 Leaf spring
211 Receiving mechanism for 209 on 202*b*
212 Receiving mechanism for 210 on 202*b*
213 Support
213*a* Head of 213
214 Support
215 Track
215*a* Top surface of 215
216 Track
217 Front stop
217*a* Through-bore
218 Rear stop
218*a* Through-bore
219 First holder
219*a* Through-bore
220 Second holder
220*a* Through-bore
221 Drive
222 Rotary knob
223 Space between 215 and 209
224, 225 Lug on 202*b*
226, 227 Lug on 202*b*
228 Slider
229 Linear guide housing
229*a* Inlet bore of 229
229*b* Outlet bore of 229
A201 Distance between 215 and 209
A208 Stop on 208
H213 Height of 213
P201 Normal position/front position of 213
P202 End position/rear position of 213
P203 Centre position of 213
P204 Further position of 213
S207 Pivot axis
S208 Pivot axis
S237 Pivot axis
S238 Pivot axis
301 Adjustment device
302 Adjustment member
303 Transmission mechanism
304 Linear guide
305 Bowden cable
306 Wire cable
307, 308 Sleeve
401 Chair
402 Subframe
402*a* Base element
402*b* Carrier

403 Seat element
404 Back element
405 Spring mechanism
406 Adjustment device
407 Front swing arm
408 Rear swing arm
409 Leaf spring
409*b* Bottom surface of 409
410 Leaf spring
411 Receiving mechanism for 409 on 402*b*
412 Receiving mechanism for 410 on 402*b*
413 Support
413*a* Head of 413
414 Support
415 Track
415*a* Top surface of 415
416 Track
417 Front stop
417*a* Through-bore
418 Rear stop
418*a* Through-bore
419 First holder
419*a* Through-bore
420 Second holder
420*a* Through-bore
421 Drive
422 Rotary knob
423 Space between 415 and 409
424, 425 Lug on 402*b*
426, 427 Lug on 402*b*
428 Not occupied
429 Linear guide housing
429*a* Inlet bore of 429
429*b* Outlet bore of 429
429*c* Toothed rod on 429
430 Electric drive
431 Housing
432 Slider
433 Toothed wheel
434 Motor shaft
435 Energy storage mechanism
436 Generator
459 Second leaf spring
460 Second leaf spring
461 Spring assembly from 409 and 459
462 Spring assembly from 410 and 460
463 Support for 459
464 Support for 460
465 Bowden cable on 463
466 Bowden cable on 464
467 Connection point of 409 and 459
468 Connection point of 410 and 460
A401 Distance between 415 and 109
A408 Stop on 408
H413 Height of 413
P401 Normal position/front position of 413
P402 End position/rear position of 413
P403 Centre position of 413
P404 Further position of 413
S407 Pivot axis
S408 Pivot axis
S437 Pivot axis
S438 Pivot axis
BTE401 Actuating device
TA401-1 Electric key
TA401-2 Electric key
501 First adjustment device
502 Adjustment member
503 Transmission mechanism
504 Linear guide
505 Bowden cable
506 Wire cable
507, 508 Sleeve
551 Second adjustment device
601 Chair 601
602 Subframe
605 Spring mechanism 605
606 Adjustment device
602*a* Base element
602*b* Carrier
608 Rear swing arm
609 Leaf spring
P601, P02 Positions of 613
613 Support
613*a* Toothed rod of 613
615 Track
621 Drive
651 Adjustment member
651*a* Linear guide
651*b* Slider
652 Transmission mechanism
653 Bowden cable
654 Pivot lever
655 Connecting rod
656 Rolling-contact wheel
656*a* Toothing of 656
657 Toothed rod 657 on 602
a Distance between L654 and P654
b Distance between L654 and D655-1
α Pivot angle
UE601 First transmission ratio
UE602 Second transmission ratio UE602
P653 Point of engagement of 653 on 654
B653 Track on 654
E654 Free end of 654
L654 Pivot axis L654
655-1 First end of 655
655-2 Second end of 655
D655-1 First rotational axis of 655
D655-2 Second rotational axis of 655

The invention claimed is:

1. A chair comprising:

a subframe;

a seat element;

a back element;

a spring mechanism; and an adjustment device, wherein the spring mechanism comprises a leaf spring clamped on one side in the subframe, and a support movable on a track between the leaf spring and the subframe, wherein the adjustment device includes an adjustment member and a transmission mechanism, wherein the adjustment member is a shaft or linear guide mechanism, wherein the chair includes an electric drive for moving the adjustment member, wherein the electric drive includes an electric linear drive or an electric rotary drive, wherein the transmission mechanism includes at least one of a rod assembly, a Bowden cable and a gear unit, and wherein the transmission mechanism is connected to the support and connected to the adjustment member, and wherein a movement of the adjustment member is translated into a movement of the support at a transmission ratio of between 1:0.5 and 1:4.

2. The chair according to claim 1, wherein the track is a curved surface adapted to a curved progression of the respectively associated leaf spring so that a movement space between the track and a bottom surface of the leaf spring permits movement of the support, unobstructed by the leaf spring, between a normal position of the support and an end position of the support, insofar as a rear swing arm is free of a load produced by a user leaning back against the back element, and wherein a distance measured in each case in a radial direction between the track and the associated leaf spring is constant in the entire movement space.

3. The chair according to claim 1, wherein the electric drive includes an energy storage mechanism for electric energy, wherein the electric drive includes an actuating device and/or a receiver for radio signals and the chair includes an electric generator, wherein the generator generates electric energy from a relative movement which occurs between individual components of the chair when the chair is used, and feeds it into the energy storage mechanism.

4. The chair according to claim 1, wherein the spring mechanism includes the first leaf spring and a second leaf spring, wherein the second leaf spring supports the back element in a normal position of the chair in which the back element is free of loads produced by a sitting person, and wherein the first leaf spring, in addition to the second leaf spring, supports the back element in an operating position that deviates from the normal position in which the back element is loaded by a person sitting and leaning back.

5. The chair according to claim 4, wherein the first leaf spring and the second leaf spring form a spring assembly and are connected together at a connection point in a region in which said spring assembly is fastened to the subframe and wherein the first leaf spring is tapered adjacent to the connection point.

6. The chair according to claim 4, the first leaf spring is supported by the first support and wherein the second leaf spring is supported by a second support, wherein the first support is slidable under the first leaf spring and wherein the second support is either fixed under the second leaf spring or is slidable under the second leaf spring independently of the first support.

7. The chair according to claim 6, wherein the first support is adjustable by the first adjustment device and wherein the second support is adjustable by a second adjustment device.

8. The chair according to claim 1, wherein the transmission mechanism comprises a pivot lever which is driven directly or indirectly by the adjustment member, wherein the transmission mechanism comprises a rolling-contact wheel with a toothing, which is driven directly or indirectly by the pivot lever, wherein the support comprises a toothed rod, wherein the rolling-contact wheel engages with its toothing in the toothed rod of the support, wherein the subframe comprises a toothed rod, and wherein the rolling-contact wheel engages with its toothing in the toothed rod of the subframe.

9. The chair according to claim 8, wherein the transmission mechanism comprises a connecting rod, wherein the pivot lever is connected to a first end of the connecting rod for rotation about a first rotational axis, wherein the rolling-contact wheel is connected to a second end of the connecting rod for rotation about a second rotational axis, wherein the rolling-contact wheel is pulled or pushed by the connecting rod over the toothed rod of the subframe during a rotation movement of the pivot lever and, in the process, the support located between the leaf spring and the rolling-contact wheel is entrained and moved by the rotating and moving rolling-contact wheel.

10. The chair according to claim 9, wherein the pivot lever is mounted on the subframe pivotably about a pivot axis, wherein the pivot axis of the pivot lever and the first rotational axis of the connecting rod and the second rotational axis of the connecting rod extend parallel to each other.

11. The chair according to claim 8, wherein the transmission mechanism comprises a Bowden cable or a gear unit, wherein the Bowden cable or the gear unit is connected to the adjustment member and to the pivot lever, wherein the Bowden cable or the gear unit is secured on the pivot lever eccentrically with respect to the pivot axis of the pivot lever with an eccentricity.

12. The chair according to claim 1, wherein the transmission mechanism comprises a rolling-contact wheel with a toothing, wherein the rolling-contact wheel is directly or indirectly connected to the adjustment member and is pulled or pushed by means of the latter over a toothed rod of the subframe, wherein the rolling-contact wheel engages with its toothing in a toothed rod of the support and thereby entrains and moves the support located between the leaf spring and the rolling-contact wheel.

* * * * *